US008857183B2

(12) United States Patent
Maruyama

(10) Patent No.: US 8,857,183 B2
(45) Date of Patent: Oct. 14, 2014

(54) STEAM TURBINE, POWER PLANT AND METHOD FOR OPERATING STEAM TURBINE

(75) Inventor: Takashi Maruyama, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 281 days.

(21) Appl. No.: 13/171,559

(22) Filed: Jun. 29, 2011

(65) Prior Publication Data

US 2012/0137687 A1 Jun. 7, 2012

(30) Foreign Application Priority Data

Dec. 6, 2010 (JP) ..... 2010-271831

(51) Int. Cl.

| | |
|---|---|
| ***F01K 13/00*** | (2006.01) |
| ***F01K 17/00*** | (2006.01) |
| ***G21D 5/00*** | (2006.01) |
| ***F01D 3/02*** | (2006.01) |
| ***F01K 7/38*** | (2006.01) |
| ***F01D 13/02*** | (2006.01) |
| ***F01D 1/04*** | (2006.01) |

(52) U.S. Cl.

CPC .. *F01D 1/04* (2013.01); *F01D 3/02* (2013.01); *F01K 7/38* (2013.01); *F01D 13/02* (2013.01); *F05D 2220/31* (2013.01)

USPC ..... 60/645; 60/644.1; 60/677

(58) Field of Classification Search

USPC ..... 60/645, 670, 653, 644.1, 677; 415/104–107

See application file for complete search history.

(56) References Cited

U.S. PATENT DOCUMENTS

| | | | | | |
|---|---|---|---|---|---|
| 4,336,105 | A | * | 6/1982 | Silvestri, Jr. | 60/644.1 |
| 4,366,675 | A | | 1/1983 | Nishioka | |
| 4,407,131 | A | * | 10/1983 | Wilkinson | 60/648 |
| 5,269,648 | A | | 12/1993 | Freuschle | |

(Continued)

FOREIGN PATENT DOCUMENTS

| | | |
|---|---|---|
| EP | 2 136 037 | 12/2009 |
| GB | 100369 | 4/1917 |

(Continued)

OTHER PUBLICATIONS

International Preliminary Report on Patentability, with English translation, issued Jun. 20, 2013 in corresponding International Application No. PCT/JP2011/061110.

(Continued)

*Primary Examiner* — Christopher Jetton
*Assistant Examiner* — Deming Wan
(74) *Attorney, Agent, or Firm* — Wenderoth, Lind & Ponack, L.L.P.

(57) ABSTRACT

The steam turbine includes the high-and-intermediate pressure turbine of the single flow type, the intermediate-pressure turbine of the single flow type, and the steam passage that communicates a location on a part way of the steam flow inside the high-and-intermediate pressure turbine, to the steam inlet of the intermediate-pressure turbine. The high-and-intermediate pressure turbine includes the high-pressure part on the steam inlet side and the intermediate-pressure part on the steam outlet side. The steam passage feeds a part of the steam having passed through the high-pressure part, from the location between the high-pressure part and the intermediate-pressure part, to the intermediate-pressure turbine.

14 Claims, 4 Drawing Sheets

(56) References Cited

U.S. PATENT DOCUMENTS

| | | | | |
|---|---|---|---|---|
| 6,332,754 | B1 * | 12/2001 | Matsuda et al. | 415/191 |
| 6,705,086 | B1 * | 3/2004 | Retzlaff et al. | 60/653 |
| 6,957,945 | B2 * | 10/2005 | Tong et al. | 415/1 |
| 2003/0043952 | A1 * | 3/2003 | Itou et al. | 376/211 |
| 2003/0175117 | A1 | 9/2003 | Klaus et al. | |
| 2004/0101395 | A1 | 5/2004 | Tong et al. | |

FOREIGN PATENT DOCUMENTS

| | | |
|---|---|---|
| JP | 55-109707 | 8/1980 |
| JP | 57-52607 | 3/1982 |
| JP | 57-171003 | 10/1982 |
| JP | 62-218606 | 9/1987 |
| JP | 7-233704 | 9/1995 |
| JP | 7-332018 | 12/1995 |
| JP | 10-266811 | 10/1998 |
| JP | 2000-291403 | 10/2000 |
| JP | 2002-508044 | 3/2002 |
| JP | 2003-74309 | 3/2003 |
| JP | 2003-239704 | 8/2003 |
| JP | 2004-011609 | 1/2004 |
| JP | 2004-190672 | 7/2004 |
| JP | 2009-257178 | 11/2009 |
| JP | 2010-519452 | 6/2010 |
| WO | 97/30272 | 8/1997 |
| WO | 2008/104465 | 9/2008 |

OTHER PUBLICATIONS

Search Report issued Apr. 3, 2014, in corresponding European Application No. 11847591.2.

Japanese Office Action issued May 29, 2014 in corresponding Japanese Application No. 2010-271831 (with English translation).

Decision to Grant a Patent issued Aug. 8, 2014 in corresponding Japanese Patent Application No. 2010-271831, together with English translation thereof.

* cited by examiner

STEAM TURBINE, POWER PLANT AND METHOD FOR OPERATING STEAM TURBINE

BACKGROUND OF THE INVENTION

1. Field of the Invention

The present invention relates to the steam turbine used in a power plant such as a nuclear power plant. Further, the present invention relates to the method for operating the steam turbine and the power plant therewith. The present invention especially relates to: the steam turbine into which a vast flow rate of the high pressure steam generated in a nuclear power plant streams; and, the method for operating the steam turbine and the power plant therewith.

2. Background of the Invention

In a nuclear power plant, a nuclear reactor generates steam; the generated steam is supplied to a steam turbine in which a turbine rotor is rotated so that an electric generator coupled to the turbine rotor produces electric power. In general, the high pressure steam generated by the nuclear reactor is fed to a high pressure (steam) turbine of a double flow type as well as to low-pressure (steam) turbines, the low-pressure (steam) turbine being provided as a subsequent stage turbine following the high pressure turbine; or, the high pressure steam generated by the nuclear reactor is fed to a high pressure turbine of a single flow type, an intermediate pressure turbine of a single flow type, and at least one low-pressure turbine, the low-pressure turbine being provided as a subsequent stage turbine following the high pressure turbine and the intermediate pressure turbine.

Incidentally, a steam turbine of a single flow type means a steam turbine in which the working steam streams toward one direction along the rotor shaft; and, a steam turbine of a double flow type means a steam turbine in which the working steam enters the steam turbine from a middle section and streams toward two directions along the rotor shaft (i.e. toward the fore and aft directions along the rotor shaft).

JP1995-332018 discloses a nuclear power plant in which, for example, a high pressure turbine of a double flow type as well as at least one low-pressure turbine is provided, the low-pressure turbine being provided as a subsequent stage turbine following the high pressure turbine. In the disclosed nuclear power plant, the steam generated by the nuclear reactor firstly streams into the high pressure turbine of a double flow type so as to produce mechanical work; then, the steam streams into the low-pressure turbine, after the moisture (mist) of the steam is removed by a moisture separation heater and the steam is heated up by the moisture separation heater.

Further, JP1987-218606 discloses a nuclear power plant in which a high pressure turbine of a single flow type, an intermediate pressure turbine of a single flow type, and at least one low-pressure turbine are provided, the low-pressure turbine being provided as a subsequent stage turbine following the high pressure turbine and the intermediate pressure turbine. In the nuclear power generating system, the steam generated by the nuclear reactor firstly streams into the high pressure turbine of the single flow type so as to produce mechanical work; then, the steam discharged from the high pressure turbine is demisted (i.e. the moisture of the steam is removed) and heated-up by a moisture separation heater; then, the steam enters the intermediate pressure turbine and produces mechanical work; further, the steam is again demisted and heated-up by a moisture separation heater. Subsequently, the steam enters the low-pressure turbine.

Further, JP1995-233704, JP1998-266811, JP2002-508044 and WO1997/30272 disclose the examples of steam turbine plants; each of the turbine plants includes a high pressure turbine of single flow type, an intermediate pressure turbine of a double flow type and a low-pressure turbine as a subsequent stage turbine that follows the high pressure turbine and the intermediate pressure turbine. Hereby, it is noted that the steam turbine plants disclosed by JP1995-233704, JP1998-66811, JP2002-508044 and WO997/30272 disclose are not always for the nuclear power plants,

SUMMARY OF THE INVENTION

In view of the electrical efficiency regarding the field of the steam turbine technology, the mass flow rate of the steam generated by the nuclear reactor becomes greater and greater, in recent years; and, the pressure of the generated steam becomes higher and higher. Thereby, the increase rate (growth rate) regarding the pressure of steam outpaces the increase rate (growth rate) regarding the mass flow rate.

In other words, the pressure increase tendency outpaces the mass flow rate increase tendency.

In this way, when the mass how rate of the steam generated by the nuclear reactor is increased and the specific volume of the steam is reduced in response to the steam pressurizing, then the volume flow rate of the steam at the steam inlet of the high pressure turbine is reduced. Accordingly, in the case where the high pressure turbine of the double flow type as described in JP1995-332018 is used for treating with the reduction regarding the volume flow rate, the reduced volume flow (that is already of a small flow rate as a steam flow rate passing through the high pressure turbine) regarding the steam is further branched into two ways further, the blades in the neighborhood of the steam inlet of the high-pressure turbine are designed based on the reduced steam flow rate. Thus, the length (height) of the blades in the neighborhood of the steam inlet becomes excessively short. Accordingly, in relation to the boundary layers that are formed around the surface walls of the rotor or in the neighborhood of surface walls inside of the turbine casing, the ratio of the steam inside of the boundary layers to the whole steam passing through the turbine becomes greater; namely, the energy loss dissipated in the boundary layers becomes remarkable. in this way, the performance of the steam turbine is often deteriorated.

On the other hand, as is the case with the disclosure of JP1987-218606, in the combination of the high pressure turbine of the single flow type and the intermediate pressure turbine of the single flow type, the steam is not branched at the steam inlet of the high pressure turbine; thus, the excessive reduction regarding the length of the blades in neighborhood of the steam inlet is not caused, the excessive reduction being derived from the reduction regarding the specific volume of the steam supplied to the turbine. Hence, in this case, the turbine performance deterioration due to the loss dissipated inside of the boundary layers can be prevented from being remarkably noticed.

However, in the case where the steam pressure at the steam outlet (an inlet pressure of the low-pressure turbine) of the intermediate pressure turbine of the single flow type of JP1987-218606 is designed approximately the same as a conventional steam turbine, with an increased amount of steam, the volume flow rate of the steam at the outlet of the intermediate pressure turbine increases. This results in increasing, the bending moment acting on the intermediate pressure turbine. Further, it is necessary to increase the length of the blades for an amount corresponding to the increased volume flow rate of the steam at the outlet of the intermediate pressure turbine. This leads to an increase in centrifugal force acting on the blades and the rotor of the intermediate pressure turbine.

Therefore, it becomes difficult to secure enough strength of the intermediate pressure turbine to withstand the increased centrifugal force of the intermediate pressure turbine and the increased bending moment.

Of course, by increasing the steam pressure at the steam outlet of the intermediate pressure turbine, the increase of the volume flow rate of the steam can be suppressed. However, this leads to an increase in the inlet pressure of the low-pressure turbine, and it becomes necessary to decrease the steam pressure to a grater degree at the low-pressure turbine. This causes the length (number of stages) of the rotor in the rotor shaft direction to be longer. Therefore, there is a limit on increasing the steam pressure at the steam outlet of the intermediate pressure turbine.

Thus, if it is taken into consideration that the volume of the steam generated by the nuclear reactor increases in capacity, and the pressure of the steam increases with an increase rate higher than the rate of the capacity increase, then it is anticipated that the steam turbines disclosed by Patent References 1 and 2 are not able to cope with the future problems regarding the increase in the capacity and pressure of the generated steam. Hence, the inventors of this application are committed to realizing a steam turbine plant (that uses the steam generated by a nuclear power plant) by which the problems of the steam volume increase in capacity and the steam pressure increase in pressure level can be coped with, the pressure level increasing with an increase rate higher than the rate of the capacity increase.

At first, the inventors of this application had an idea that the steam turbines disclosed by JP1995-233704, JP1998-266811, JP2002-508044 and WO1997/30272 are applied to a nuclear power plant by use of the combination of the high pressure turbine of the single flow type and the intermediate pressure turbine of the double flow type.

FIG. 6 shows the combination of the high pressure turbine of the singe flow type and the intermediate pressure turbine of the double flow type. As shown in FIG. 6, a steam turbine 100 includes is a high pressure turbine 102 of the single flow type and an intermediate pressure turbine 104 of the double flow type. The steam generated by the nuclear reactor (not shown) produces mechanical work firstly in the high pressure turbine and secondly in the intermediate pressure turbine, the steam supplied from the reactor passing, through firstly the high pressure turbine and secondly the intermediate pressure turbine.

In the combination of the steam turbines 100, the high pressure turbine 102 is of the single flow type and the flow of the steam entering the high pressure turbine 102 is not branched at the inlet thereof; thus, it is unnecessary to set the blade length excessively short. Thus, the deterioration of the turbine performance due to the dissipation loss in the boundary layers is not caused.

Further, the intermediate pressure turbine 104 is of the double flow type; the steam that enters the intermediate pressure turbine 104 is branched; accordingly, the volume flow rate of the steam at the outlet of the intermediate pressure turbine 104 is not-so-high. Hence, the problem regarding the strength of the intermediate pressure turbine 104 due to the centrifugal force or the bending moment that act on the rotor of the turbine 104 is seldom caused; thereby, the bending moment is generated by the force as a steam flow drag acting on each rotor blade.

However, in the case of the steam turbine 100, the high pressure turbine 102 has to devote a large space to the steam discharge area (i.e. the area marked with the letter A in FIG. 6); thus, the whole length of the rotor has to be prolonged in the rotor shaft direction. Moreover, the diameter of a reheat line 106 through which all of the steam streams from the high pressure turbine 102 toward the intermediate pressure turbine 104 has to be large. As a result, a large space is needed as a connection area (i.e. the area marked with the letter B in FIG. 6) where the reheat line 106 is connected to the steam inlet of the intermediate pressure turbine 104. In this way, the whole length of the rotor has to be further prolonged in the rotor shaft direction.

In view of the difficulties or problems in the conventional technology as described above, the present invention aims at providing a steam turbine, a steam turbine power plant therewith and a method for operating the steam turbine; thereby, the increasing trend in the steam volume flow rate capacity as well as the steam pressure level can be coped with, the pressure level increasing with an increase rate higher than the rate of the capacity increase.

In order to overcome the problems in the conventional technologies, the present invention discloses a steam turbine including, but not limited to:

a high-and-intermediate pressure turbine of a single flow type in which a steam fed through a steam inlet streams to a steam outlet via a high-pressure part in the high-and-intermediate pressure turbine and an intermediate-pressure part on a downstream side of the high-pressure part in the high-and-intermediate pressure turbine;

an intermediate-pressure turbine of a single flow type; and a steam pas sage that communicates a location between the high-pressure part and the intermediate-pressure part of the high-and-intermediate pressure turbine to an inlet of the intermediate-pressure turbine, wherein a part of the steam having passed through the high-pressure part of the high-and-intermediate pressure turbine is fed to the intermediate-pressure turbine via the steam passage.

Hereby, a steam turbine of a single flow type means a steam turbine in which the working steam streams toward one direction along the rotor shaft; and, a steam turbine of a double flow type means a steam turbine in which the working steam enters the steam turbine from a middle section and streams toward two directions along the rotor shaft (i.e. toward the fore and aft directions along the rotor shaft).

According to the above, the steam turbine is provided with the high-and-intermediate pressure turbine of the single flow type, and the intermediate-pressure turbine of the single flow type; in addition, the steam passage is arranged so as to communicate the location between the high-pressure part of the high-and-intermediate pressure turbine and the intermediate-pressure part of the high-and-intermediate pressure turbine, to the steam inlet of the intermediate-pressure turbine. A part of the steam having passed through the high-pressure part of the high-and-intermediate pressure turbine subsequently streams through the intermediate-pressure part of the high-and-intermediate pressure turbine; and, the remaining part of the steam having passed through the high-pressure part streams into the intermediate-pressure turbine via the steam passage.

Hereby, since the high-and-intermediate pressure turbine is of the single flow type, the steam flow of the steam that enters the steam inlet of the high-and-intermediate pressure turbine is not branched at the steam inlet. Hence, even in a case where the inlet steam pressure level as well as the steam volume flow rate capacity is increased so that the increased ratio regarding the steam pressure level is higher than the increased ratio regarding the steam volume flow rate capacity, it is unnecessary to set the length of the blades on the steam inlet side of the high-and-intermediate pressure turbine excessively low. Accordingly, the turbine performance deterioration attributable to the dissipation loss generated in the boundary layers can be restrained.

Further, although the high-and-intermediate pressure turbine and the intermediate-pressure turbine are of a single flow type, a part of the flow of the steam having entered the high-pressure part of the high-and-intermediate pressure turbine is branched at a location in the high-and-intermediate pressure turbine on a part way of the steam flow through the high-and-intermediate pressure turbine; and, the steam of the branched flow streams into the intermediate-pressure turbine. Therefore, the volume flow rate of the steam at the steam outlet of the intermediate-pressure part of the high-and-intermediate pressure turbine as well as at the steam outlet of the intermediate-pressure turbine is restrained. Thus, the increases regarding the centrifugal force and the bending moment which act on the turbine rotor of the high-and-intermediate pressure turbine as well as of the intermediate-pressure turbine can be restrained.

Moreover, the steam that has passed through the high-pressure part of the high-and-intermediate pressure turbine and is not fed to the intermediate-pressure turbine is never once discharged outsides; the steam subsequently streams through the intermediate-pressure part of the high-and-intermediate pressure turbine. Therefore, it becomes unnecessary to independently provide a steam discharge area at the steam outlet of the high-pressure part of the high-and-intermediate pressure turbine; accordingly, as for the whole length in the rotor longitudinal direction, the steam turbine can be shorter, in comparison with the conventional approach.

Further, a part of the steam that has passed through the high-pressure part of the high-and-intermediate pressure turbine passes through the branched steam passage toward the intermediate pressure turbine; and, it is unnecessary that the diameter of the steam passage is remarkably large. Thus, a connection area where the steam passage is connected to the steam inlet of the intermediate-pressure turbine can be compact; accordingly, as for the whole length in the rotor longitudinal direction, the steam turbine can be shorter, in comparison with the conventional approach.

A preferable embodiment is the steam turbine, wherein the high-and-intermediate pressure turbine and the intermediate-pressure turbine are housed in a common casing.

The steam turbine 100 (cf. FIG. 6) requires a large space, namely the steam discharge area A, for discharging the steam having streamed through the high pressure turbine 102, as well as, a large space, namely, the connection area B, for connecting the reheat line 106 to the steam inlet of the intermediate pressure turbine 104; thus, the whole length of the rotor of the high pressure turbine 102 and the intermediate pressure turbine 104 has to be prolonged in the rotor shaft direction. Accordingly, when the rotor of the high pressure turbine 102 and the rotor of the intermediate pressure turbine 104 are housed in a common turbine casing so that the whole rotor is supported by two bearings, the rotor shaft vibration is likely to happen. Hence, in the actual practice, the turbine casing is obliged to be configured with two casings: the high-pressure casing for housing the rotor of the high pressure turbine 102 and the intermediate pressure casing for housing the intermediate pressure turbine 104. Consequently, each of the rotor shaft parts regarding the high pressure turbine 102 and the intermediate pressure turbine 104 has to be supported by own bearings 108 and be provided with own glands 110. In this way, the problem regarding the friction loss at the bearings as well as the steam leakage at the glands is likely to happen.

On the other hand, the steam turbine according to the disclosure as described above needs to be provided with no own steam discharge area; moreover, the connection area where the steam passage toward intermediate pressure turbine 104 is connected thereto can be compact in comparison with the conventional connection area. In this way, the length of the whole rotor in the rotor shaft longitudinal direction becomes shorter; and the shaft vibration problem is less likely to happen. Thus, the rotor of the high pressure turbine 102 and the rotor of the intermediate pressure turbine 104 can be housed in a common turbine-casing; as a result, the number of bearings 108 as well as the number of glands 110 can be reduced. Therefore, the friction loss at the bearings as well as the steam leakage at the glands can be constrained.

Another preferable embodiment is the steam turbine, wherein the steam turbine further comprises a moisture separation mechanism provided in the steam passage to separate moisture of the steam streaming through the steam passage.

As described above, the steam passage, namely, the steam bleeding passage is provided; and, the moisture separation mechanism can be provided. Thus, the moisture of the steam streaming through the steam bleeding passage is removed by use of the moisture separation mechanism, the steam bleeding passage being branched at a location on a part way of the steam flow through the high-and-intermediate pressure turbine. The erosion that is attributable to the water droplet included in the steam flow entering the intermediate-pressure turbine can be prevented; and, the turbine performance deterioration can be also prevented. Incidentally, a demister, for instance, of a chevron type or of a wire mesh type can be used as the moisture separation mechanism.

Another preferable embodiment is the steam turbine, wherein the steam turbine further comprises a heating mechanism provided in the steam passage to heat-up the steam streaming through the steam passage.

Providing the steam bleeding passage makes it possible to provide a steam heating mechanism. When the steam streaming toward the intermediate-pressure turbine through the steam bleeding passage branched from a location on a part way of the steam flow through the high-and-intermediate pressure turbine is heated up, and then the heat cycle efficiency of the steam turbine can be enhanced.

Another preferable embodiment is the steam turbine, wherein a flow rate of the steam streaming through the intermediate-pressure part in the high-and-intermediate pressure turbine is approximately equal to a flow rate of the steam streaming through the intermediate-pressure turbine.

As described above, when the flow rate of the steam streaming through the intermediate-pressure part in the high-and-intermediate pressure turbine is approximately equal to the flow rate of the steam streaming through the intermediate-pressure turbine, then the flow rate of the steam entering the steam turbine is almost evenly divided into the flow rate of the steam streaming the intermediate-pressure part in the high-and-intermediate pressure turbine and the flow rate of the steam streaming the intermediate-pressure turbine. Thus, the increases regarding the centrifugal force and the bending moment which act on the turbine rotor of the high-and-intermediate pressure turbine as well as of the intermediate-pressure turbine can be evenly restrained.

Another pre preferable embodiment is the steam turbine, wherein the high-and-intermediate pressure turbine and the intermediate-pressure turbine are arranged to be on a same axis; and, a direction of a steam flow in the high-and-intermediate pressure turbine is arranged to be opposite to a direction of a steam flow in the intermediate-pressure turbine.

As described above, a part of the thrust force acting on the high-and-intermediate pressure turbine can be canceled by the thrust force acting on the intermediate pressure turbine; thus, the dummy that is provided so as to reduce the resultant thrust force can be downsized.

Another preferable embodiment is a power generating plant (power plant), including, but not limited to, the steam turbine according to the above disclosures.

In this manner, a power plant of a large capacity and a high efficiency can be realized with a compact structure, which corresponds to the steam volume increase in capacity and the steam pressure increase in pressure level. As a result, it is possible to lower an installation cost of such power plant.

The present invention discloses a method for operating a steam turbine that includes, but not limited to:

a high-and-intermediate pressure turbine of a single flow type, the high-and-intermediate pressure turbine having a high-pressure part and an intermediate-pressure part on a downstream side of the high-pressure part; and, an intermediate-pressure turbine of a single flow type, the high-and-intermediate pressure turbine and the intermediate-pressure turbine being provided between a steam inlet and a steam outlet, the method comprising the steps of:

expanding a steam supplied through the steam inlet of the high-and-intermediate pressure turbine in the high-pressure part;

branching a flow of the steam having passed through the high-pressure part into a flow of a first steam and a flow of a second steam;

expanding the first steam in the intermediate-pressure part of the high-and-intermediate pressure turbine; and leading the second steam into the intermediate-pressure turbine so as to expand the second steam in the intermediate-pressure turbine.

As described above, according to the method for operating the steam turbine, the flow of the steam having passed through the high-pressure part in the high-and-intermediate pressure turbine is branched into the flow of the first steam and the flow of the second steam; the first steam subsequently streams through intermediate-pressure part, whereas the second steam is fed to the intermediate-pressure turbine. Hereby, it is noted that the flow of the second steam may be realized by providing a communication steam-passage that communicate a location between the high-and intermediate-pressure part of the high-and-intermediate pressure turbine, to the steam inlet of the intermediate-pressure turbine as well as by feeding the second steam toward the intermediate-pressure turbine via the communication steam-passage.

Further, since the high-and-intermediate pressure turbine is of a single flow type, the flow of the steam is not branched on the steam inlet side of the high-and-intermediate pressure turbine (i.e. in the high-pressure part). Hence, in designing the steam turbine, even when the upsizing ratio regarding the steam pressure level exceeds the upsizing ratio regarding the steam flow rate capacity, it is unnecessary to excessively reduce the length of the blades on the steam inlet side of the high-and-intermediate pressure turbine (i.e. in the high-pressure part). Accordingly, the turbine performance deterioration attributable to the loss dissipated in the boundary layers can be restrained.

Further, although the high-and-intermediate pressure turbine as well as the intermediate-pressure turbine is of a single flow type, a part of the steam entering the high-pressure part in the high-and-intermediate pressure turbine is branched on a part way of the steam flow in the high-and-intermediate pressure turbine, the part of the steam streaming toward the intermediate-pressure turbine. Thus, the volume flow rate of the steam at the intermediate-pressure part of the high-and-intermediate pressure turbine as well as at the outlet of the intermediate-pressure turbine is restrained. Accordingly, the centrifugal force and the bending moment that act on the rotor of the high-and-intermediate pressure turbine as well as the intermediate-pressure turbine can be restrained.

Moreover, the steam that has passed through the high-pressure part of the high-and-intermediate pressure turbine and is not fed to the intermediate-pressure turbine is never once discharged outsides; the steam subsequently streams through the intermediate-pressure part of the high-and-intermediate pressure turbine. Therefore, it becomes unnecessary to specially provide an own steam discharge area at the steam outlet of the high-pressure part of the high-and-intermediate pressure turbine; accordingly, as for the whole length in the rotor longitudinal direction, the steam turbine can be shorter, in comparison with the conventional approach.

According to the present invention, the steam turbine is provided with the high-and-intermediate pressure turbine of a single flow type and the intermediate-pressure turbine of a single flow type; a steam passage is arranged so as to communicate a location between the high-pressure part and the intermediate pressure part in the high-and-intermediate pressure turbine, to the intermediate-pressure turbine; thus, a part of the steam that has passed through the high-pressure part in the high-and-intermediate pressure turbine subsequently streams the intermediate-pressure part in the high-and-intermediate pressure turbine, whereas the remaining part of the steam streams into the intermediate-pressure turbine via the steam passage.

Further, since the high-and-intermediate pressure turbine is of a single flow type, the flow of the steam is not branched on the steam inlet side of the high-and-intermediate pressure turbine (i.e. in the high-pressure part). Hence, in designing the steam turbine, even when the upsizing ratio regarding the steam pressure level exceeds the upsizing ratio regarding the steam flow rate capacity, it is unnecessary to excessively reduce the length of the blades on the steam inlet side of the high-and-intermediate pressure turbine (i.e. in the high-pressure part). Accordingly, the turbine performance deterioration attributable to the loss dissipated in the boundary layers can be restrained.

Further, although the high-and-intermediate pressure turbine as well as the intermediate-pressure turbine is of a single flow type, a part of the steam entering the high-pressure part in the high-and-intermediate pressure turbine is branched on apart way of the steam flow in the high-and-intermediate pressure turbine, the part of the steam streaming toward the intermediate-pressure turbine. Thus, the volume flow rate of the steam at the intermediate-pressure part of the high-and-intermediate pressure turbine as well as at the outlet of the intermediate-pressure turbine is restrained. Accordingly, the centrifugal force and the bending moment that act on the rotor of the high-and-intermediate pressure turbine as well as the intermediate-pressure turbine can be restrained.

Moreover, the steam that has passed through the high-pressure part of the high-and-intermediate pressure turbine and is not fed to the intermediate-pressure turbine is never once discharged outsides; the steam subsequently streams through the intermediate-pressure part of the high-and-intermediate pressure turbine. Therefore, it becomes unnecessary to specially provide an own steam discharge area at the steam outlet of the high-pressure part of the high-and-intermediate pressure turbine; accordingly, as for the whole length in the rotor longitudinal direction, the steam turbine can be shorter, in comparison with the conventional approach.

Further, a part of the steam that has passed through the high-pressure part of the high-and-intermediate pressure turbine passes through the branched steam passage toward the intermediate pressure turbine; and, it is unnecessary that the diameter of the steam passage is remarkably large. Thus, a connection area where the steam passage is connected to the steam inlet of the intermediate-pressure turbine can be compact; accordingly, as for the whole length in the rotor longitudinal direction, the steam turbine can be shorter, in comparison with the conventional approach.

DETAILED DESCRIPTION OF THE PREFERRED EMBODIMENTS

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

In addition, the steam turbine that will be explained in the following context can be preferably and especially applicable to a nuclear power plant in which the steam of a great volume flow rate is generated and supplied to the steam turbine; however, it goes without saying that the steam turbine according to the present invention can be applicable to another type of power plant such as a thermal heat plant.

First Mode

Figure 1:
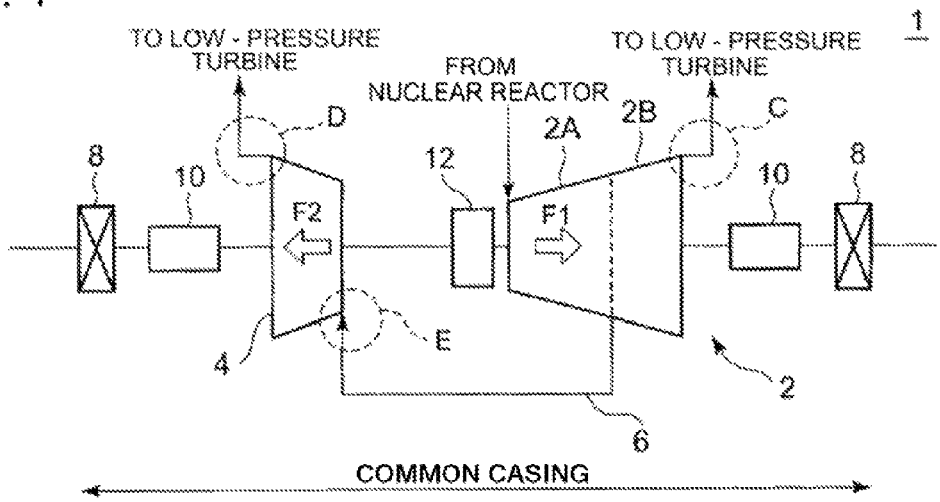
FIG. 1 shows an exemplary configuration regarding a steam turbine according to a first mode of the present invention.

In the following context, the steam turbine according to a first mode of the present invention will be explained, the steam turbine being used for a nuclear power plant FIG. 1 shows an exemplary configuration regarding a steam turbine according to the first mode of the present invention. As shown in FIG. 1, the steam turbine 1 includes, but is not limited to, a high-and-intermediate pressure turbine 2 of a single flow type, an intermediate-pressure turbine 4 of a single flow type, and a steam passage 6 communicating the high-and-intermediate pressure turbine 2 to the intermediate-pressure turbine 4.

The high-and-intermediate pressure turbine 2 is provided with a high-pressure part 2A and an intermediate-pressure part 2B; the steam generated by the nuclear reactor firstly streams through the high-pressure part 2A. On the other hand, a part of the steam having passed through the high-pressure part 2A subsequently streams through the intermediate-pressure part 2B, the part of steam being not delivered to the intermediate-pressure turbine 4 via the steam passage 6. The intermediate-pressure part 2B is connected to a low-pressure turbine (not shown) so that the steam having passed through the intermediate-pressure part 2B is fed to the low-pressure turbine, via a moisture separation heater (not shown in FIG. 1) in which the moisture of the steam is removed and the steam is heated-up.

It is preferable that the casing for the intermediate-pressure turbine 4 is integrated with the casing for the high-and-intermediate turbine 2 (namely, the intermediate-pressure turbine 4 and the high-and-intermediate turbine 2 are housed in a common casing). In this way, the number of the bearings to be provided on the rotor penetrating part (i.e. on a common rotor shaft) can be reduced to a minimal number (e.g. 2 bearings); and, the number of the glands to be provided on the rotor penetrating part (i.e. on a common rotor shaft) can be reduced to a minimal number (e.g. 2 glands). Hence, the friction loss generated in the bearings as well as the steam leakage through the glands can be restrained.

Incidentally, as described above, the intermediate-pressure turbine 4 and the high-and-intermediate turbine 2 are housed in a common turbine-casing in this mode of the present invention; the reason is, as described later, that the whole rotor length in the rotor shaft direction can be reduced in comparison with the whole rotor length of the steam turbine 100 depicted in FIG. 6, and the rotor shaft vibration is less likely to happen.

The steam that enters the high-and-intermediate pressure turbine 2 is branched at a middle location on a partway (i.e. at a location between the high-pressure part and the intermediate-pressure part) of the steam flow inside of the high-and-intermediate pressure turbine 2; the steam of the branched flow is fed to the intermediate-pressure turbine 4 via steam passage 6. Further, the steam outlet of the intermediate-pressure turbine 4 is connected to the low-pressure turbine (not shown); the steam discharged from the steam outlet of the intermediate-pressure turbine 4 is fed to the low-pressure turbine, via a moisture separation heater in which the moisture of the steam is removed and the steam is heated-up.

In addition, although the pressure of the steam at the outlet of the intermediate-pressure turbine 4 is not limited to a special level, the pressure level may be almost the same as the pressure level at the steam outlet of the high-and-intermediate turbine 2 (i.e. the steam outlet of the intermediate-pressure part 2B regarding the high-and-intermediate turbine 2). In this way, the steam flow from the high-and-intermediate turbine 2 can merge with the steam flow from the intermediate-pressure turbine 4, and the confluence of the two flows can enter the low-pressure turbine; or, both the steam flows whose pressure levels are almost equivalent each other can independently enter the low-pressure turbine at the same time.

The direction of the steam flow in the intermediate-pressure turbine 4 is arranged in the direction opposite to direction of the steam flow in the high-and-intermediate pressure turbine 2; in this way, a part of the thrust force F1 acting on the high-and-intermediate pressure turbine 2 can be canceled by the thrust force F2 acting on the intermediate pressure turbine 4; or, a part of the thrust force F2 acting on the intermediate pressure turbine 4 can be canceled by the thrust force F1 acting on the high-and-intermediate pressure turbine 2. Accordingly, a dummy 12 that is provided so as to reduce the resultant thrust force can be downsized.

An end of the steam passage 6 is connected to the high-and-intermediate pressure turbine 2 at the location between the high-pressure part 2A and the intermediate-pressure part 2B regarding the steam flow inside of the high-and-intermediate pressure turbine 2; another end of the steam passage 6 is connected to the steam inlet of the intermediate-pressure turbine 4. The diameter of the steam passage 6 is preferably determined in response to the steam flow rate, in view of the pressure loss.

In addition, the steam passage 6 may be arranged only inside of a high-and-intermediate pressure casing that houses the high-and-intermediate pressure turbine 2 and the intermediate-pressure turbine 4; or, a part of the steam passage 6 may be arranged outside of the high-and-intermediate pressure casing. When the steam passage 6 is arranged only inside of a high-and-intermediate pressure casing, the whole steam turbine including the auxiliaries can be compact in size; and, when a part of the steam passage 6 is arranged outside of the high-and-intermediate pressure casing, a moisture separation mechanism or a heating mechanism can be easily installed, as described later.

The flow rate of the steam streaming through the passage 6 may be set at a level roughly equal to the half of the flow rate of the steam streaming through the high-pressure part 2A of the high-and-intermediate pressure turbine 2, so that the steam flow rate through the intermediate-pressure part 2B of the high-and-intermediate pressure turbine 2 is approximately equal to the steam flow rate through the intermediate-pressure turbine 4. In this way, (the flow rate of) the steam entering the steam turbine 1 is almost evenly distributed to the intermediate-pressure part 2A of the high-and-intermediate pressure turbine 2 and the intermediate-pressure turbine 4; and, the centrifugal force and the bending moment that act on the rotor of the high-and-intermediate pressure turbine 2 can be almost equally restrained as is the case with the centrifugal force and the bending moment that act on the rotor of the intermediate-pressure turbine 4.

As explained thus far, the steam turbine 1 according to this first mode includes, but not limited to: the high-and-intermediate pressure turbine 2 of the single flow type in which the steam fed through the steam inlet of the turbine 2 streams to the steam outlet of the turbine 2 via the high-pressure part 2A and the intermediate-pressure part 2B on the downstream side of the high-pressure part 2A; the intermediate-pressure turbine 4 of the single flow type; the steam passage 6 that communicates the location between the high-pressure part 2A of the turbine 2 and the intermediate-pressure part 2B of the turbine 2, to the steam inlet of the intermediate-pressure turbine 4. Thereby, a part of the steam having passed through the high-pressure part 2A of the turbine 2 is fed to the intermediate-pressure turbine 4, via the steam passage 6.

Further, the steam that enters the steam inlet of the high-and-intermediate pressure turbine 2 expands in the high-pressure part 2A of the turbine 2; then, the steam flow of the expanded steam is branched into a steam flow of a first steam that streams through the intermediate-pressure part 2B and a steam flow of a second steam that streams fed to the intermediate-pressure turbine 4. Next, the first steam expands in the intermediate-pressure part 2B of the turbine 2; then the first steam is fed to the low-pressure turbine (not shown). On the other hand, the second steam expands in the intermediate-pressure turbine 4; then, the second steam is fed to the low-pressure turbine (not shown).

According to the present first mode, the steam turbine is provided with the high-and-intermediate pressure turbine 2 of the single flow type, and the intermediate-pressure turbine 4 of the single flow type; in addition, the steam passage 6 is arranged so as to communicate the location between the high-pressure part 2A of the turbine 2 and the intermediate-pressure part 2B of the turbine 2, to the steam inlet of the intermediate-pressure turbine 4. On the basis of this configuration, a part of the steam having passed through the high-pressure part 2A of the turbine 2 subsequently streams through the intermediate-pressure part 2B; and, the remaining part of the steam having passed through the high-pressure part 2A streams into the intermediate-pressure turbine 4 via the steam passage 6.

Hereby, since the high-and-intermediate pressure turbine 2 is of the single flow type, the steam flow of the steam that enters the steam inlet of the turbine 2 is not branched at the steam inlet. Hence, even in a case where the inlet steam pressure level as well as the steam volume flow rate capacity is increased so that the increased ratio regarding the steam pressure level is higher than the increased ratio regarding the steam volume flow rate capacity, it is unnecessary to set the length of the blades on the steam inlet side of the turbine 2 excessively low. Accordingly, the turbine performance deterioration attributable to the dissipation loss generated in the boundary layers can be restrained.

Further, although the high-and-intermediate pressure turbine 2 and the intermediate-pressure turbine 4 are of a single flow type, a part of the flow of the steam having entered the high-pressure part 2A of the turbine 2 is branched at a location in the turbine 2 on a part way of the steam flow through the turbine 2; and, the steam of the branched flow streams into the intermediate-pressure turbine 4. In other words, with the intermediate-pressure part 2B of the high-and-intermediate pressure turbine 2 and the intermediate-pressure turbine 4, a steam turbine of a double flow type is artificially configured (i.e. a quasi intermediate-pressure turbine of a double flow type is formed). Therefore, the volume flow rate of the steam at the steam outlet of the intermediate-pressure part 2B of the high-and-intermediate pressure turbine 2 as well as at the steam outlet of the intermediate-pressure turbine 4 is restrained. Thus, the increases regarding the centrifugal force and the bending moment which act on the turbine rotor of the high-and-intermediate pressure turbine 2 as well as of the intermediate-pressure turbine 2 can be restrained.

Moreover, the steam that has passed through the high-pressure part 2A of the high-and-intermediate pressure turbine 2 and is not fed to the intermediate-pressure turbine is never once discharged outside of the high-and-intermediate pressure turbine 2; the steam streams through the intermediate-pressure part 2B of the turbine 2. Therefore, it becomes unnecessary to provide a steam discharge area corresponding to the steam discharge area such as marked with the letter A in the high pressure turbine of FIG. 6. In other words, as shown in FIG. 1, the steam discharge areas that the steam turbine 1 is provided with are limited to the steam outlet area (i.e. the area marked with the letter C in FIG. 1) of the intermediate-pressure part 2B of the high-and-intermediate pressure turbine 2 and the steam outlet area (i.e. the area marked with the letter D in FIG. 1) of the intermediate-pressure turbine 4. Thus, as for the high-pressure part 2A of the high-and-intermediate pressure turbine 2, it is unnecessary to specially provide an own steam discharge area (for the high-pressure part 2A).

Figure 6:
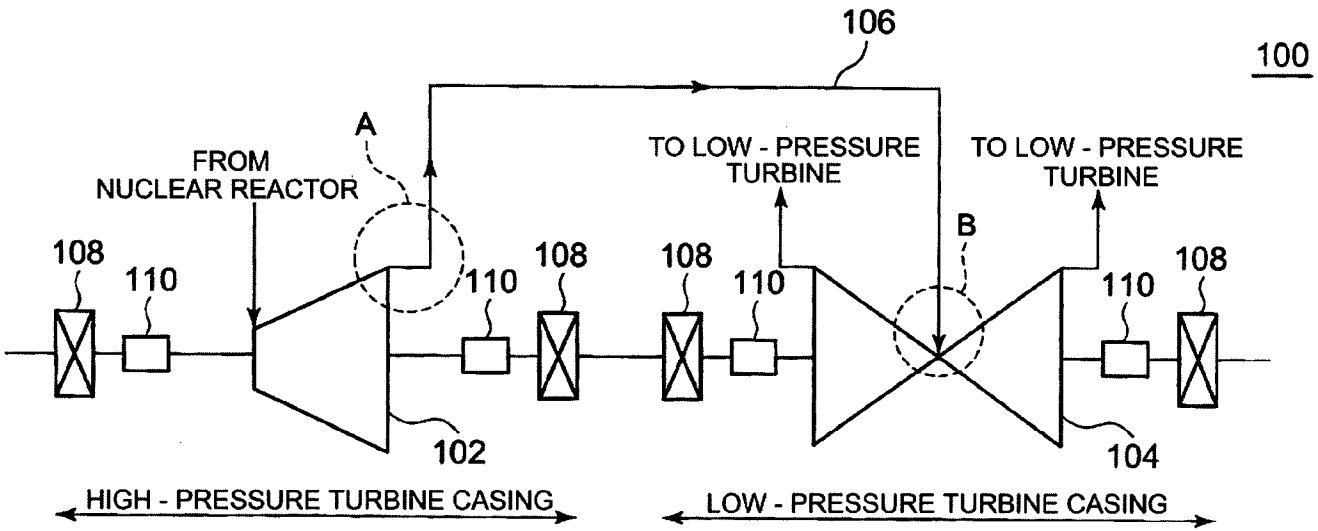
FIG. 6 shows a turbine plant which is a combination of a high pressure turbine of single flow type and an intermediate pressure turbine of a double flow type.

Further, a part of the steam that has passed through the high-pressure part 2A of the high-and-intermediate pressure turbine 2 passes through the branched steam passage 6; and, the diameter thereof can be smaller in comparison with the diameter of the reheat line 106 as depicted in FIG. 6. Thus, a connection area (i.e. the area marked with the letter E in FIG. 1) where the steam passage 6 is connected to the steam inlet of the intermediate-pressure turbine 4 can be not-so-large. In this way, as for the whole length in the rotor longitudinal direction, the steam turbine 1 can be shorter than the steam turbine 100. Accordingly, the rotor shaft vibration is less likely to happen. Further, the turbine rotor of the high-and-intermediate pressure turbine 2 and the turbine rotor of the intermediate-pressure turbine can be together combined and housed in a common casing (that may be called a high-intermediate casing). In this way, the number of the bearings 8 to be provided on the rotor penetrating part (i.e. on a common rotor shaft) can be reduced to a minimal number (e.g. 2 bearings); and, the number of the glands 10 to be provided on the rotor penetrating part (i.e. on a common rotor shaft) can be reduced to a minimal number (e.g. 2 glands). Hence, the friction loss generated in the bearings 8 as well as the steam leakage through the glands 10 can be restrained.

Second Mode

Figure 2:
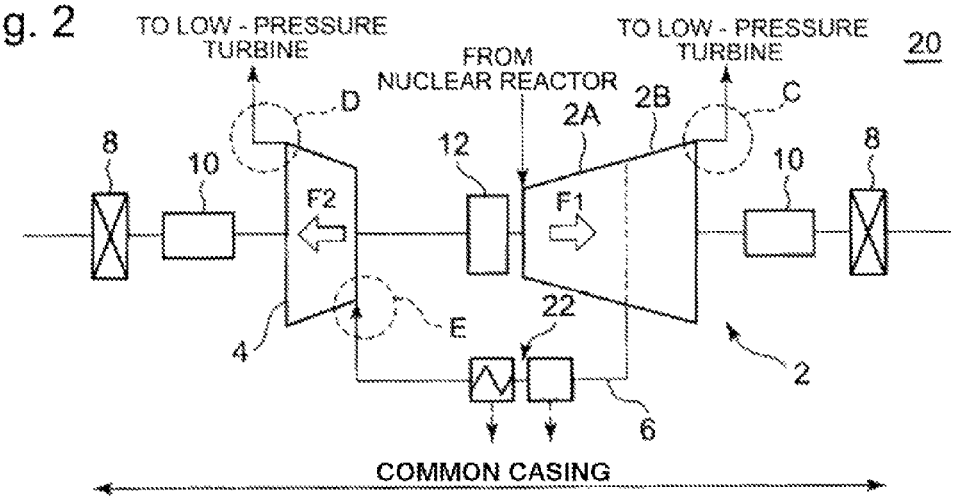
FIG. 2 shows an exemplary configuration regarding a steam turbine according to a second mode of the present invention.
Figure 3:
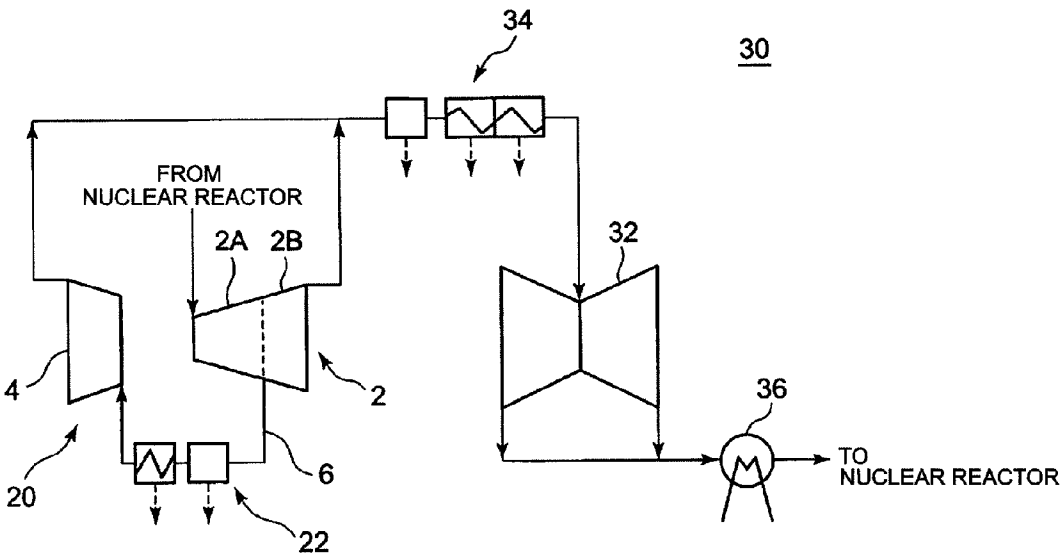
FIG. 3 shows an exemplary configuration regarding a nuclear power plant provided with the steam turbine shown in FIG. 2.

FIG. 2 shows an exemplary configuration regarding a steam turbine according to a second mode of the present invention; and, FIG. 3 shows an exemplary configuration regarding a nuclear power plant provided with the steam turbine shown in FIG. 2.

In addition, the configuration of the steam turbine 20 as depicted in FIG. 2 is the same as the configuration of the steam turbine 1 according to the first mode except that the steam turbine 20 is provided with a moisture separation heater 22 on a part way of the steam passage 6; thus, the same components in FIG. 2 as in FIG. 1 are given common numerals; and, explanation repetitions are omitted.

As shown in FIG. 2, the moisture separation heater 22 for the steam turbine 20 is arranged on a part way of the steam passage 6, so as to remove the moisture in the steam streaming through the branched line (the passage 6) that is branched from the steam flow passing through the high-and-intermediate pressure turbine 2; in addition, the moisture separation heater 22 heats-up the steam streaming through the passage 6.

As described above, the moisture in the steam streaming through the branched line (the passage 6) that is branched from the steam flow passing through the high-and-intermediate pressure turbine 2 is removed by use of the moisture separation heater 22; further, the steam passing through the moisture separation heater 22 is heated-up therein. In this way, the erosion regarding the intermediate-pressure turbine 4 can be prevented, the erosion being attributable to the water droplet included in the steam flow streaming through the intermediate-pressure turbine 4; the turbine performance deterioration can be also prevented. Further, the heat cycle efficiency of the steam turbine 20 can be enhanced.

As shown in FIG. 3, a nuclear power plant 30 includes, but not limited to, a high-and-intermediate pressure turbine 2, an intermediate-pressure turbine 4, and a low-pressure turbine 32 that forms a subsequent stage following the high-and-intermediate pressure turbine 2 and the intermediate-pressure turbine 4. A moisture separation heater 34 is provided on a part way of a steam passage line that connects the steam inlet of the low-pressure turbine 32, to the confluence point of the steam discharge line from the high-and-intermediate pressure turbine 2 and the steam discharge line from the intermediate pressure turbine 4. The moisture separation heater 34 removes the moisture of the steam having passed through the intermediate-pressure part 2B of the high-and-intermediate pressure turbine 2 as well as the intermediate-pressure turbine 4; and, the moisture separation heater 34 heats-up the steam passing through the moisture separation heater 34. Further, the steam that has passed through the low-pressure turbine 32 is fed to a condenser 36 where the steam discharged from the low-pressure turbine 32 is condensed into water; then, the water condensed at the condenser 36 is returned to the nuclear reactor.

As described above, according to the configuration in FIG. 3, the moisture of the steam that enters the intermediate-pressure turbine 4 is removed by the moisture separation heater 22; and, the steam is also heated up in the he moisture separation heater 22. Further, the moisture of the steam fed to the low-pressure turbine 32 from the high-and-intermediate pressure turbine 2 as well as from the intermediate-pressure turbine 4 is removed by the moisture separation heater 34; and, the steam is also heated up in the he moisture separation heater 34. Thus, the heat cycle efficiency can be remarkably enhanced.

In addition, the moisture separation heaters 22 and 34 are required only to remove the moisture of the steam passing through the moisture separation heaters 22 and 34, as well as heat-up the steam passing through the moisture separation heaters 22 and 34; then, any moisture separation heater can be used. Further, the products explained in the following context, for instance, may be used.

Figure 4:
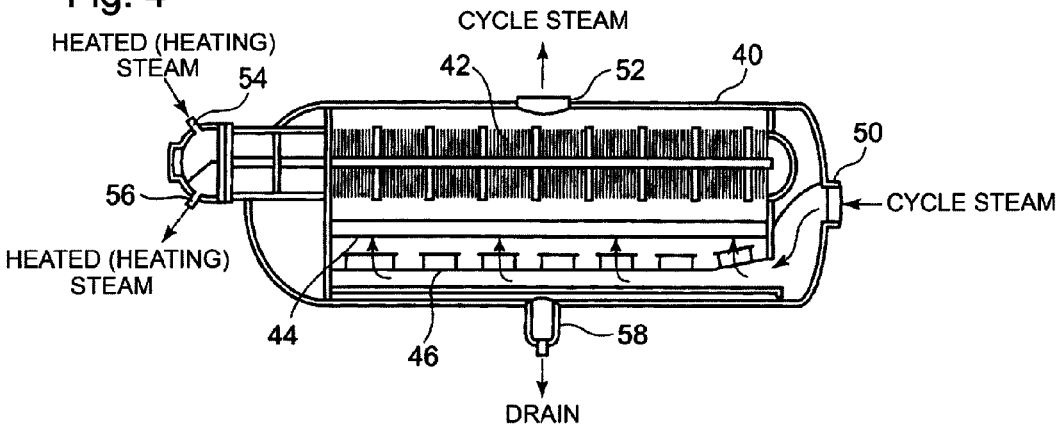
FIG. 4 shows a cross-section of a moisture separation heater, the cross-section showing an exemplary configuration regarding the moisture separation heater; and, FIG. 5 shows a bird view of an exemplary configuration regarding a demister of a chevron type.

FIG. 4 shows a cross-section of a moisture separation heater, the cross-section showing an exemplary configuration regarding the moisture separation heater. The moisture separation heater depicted in FIG. 4 includes, but not limited to: a heater tube 42 that is arranged in a body 40 of the moisture separation heater, the body being of a cylindrical shape; a demister 44; and, a stream rectifying perforated-panel 46. The steam (i.e. the cycle steam) enters the inside of the body 40 via a cycle steam inlet 50; the cycle steam streams once downward then upward; and, the cycle steam is lastly discharged out of the body 40 via a cycle steam outlet 52. While the cycle steam streams inside of the body 40 toward the cycle steam outlet 52, the flow of the cycle steam is rectified through the stream rectifying perforated-panel 46 and the moisture of the cycle steam is separated by the demister 44; then, the cycle steam is heated up by the heater tube 42. Incidentally, the moisture separated by the demister is discharged out of the body 40 via a drain outlet 58

The heater tube 42 is configured with a tube with a plurality of fins such as a U-tube with fins. The heated steam (that may be called the heating steam) that is supplied through a heating steam inlet 54 streams inside of the heater tube 42 and the cycle steam that has passed through the demister 44 streams outside of the heater tube 42. This allows the cycle steam to be heated by heat exchange with the heated steam (i.e. the heating steam). The heated steam having heated the cycle steam is discharged out of the heater tube 42 via a heating steam outlet 56.

Figure 5:
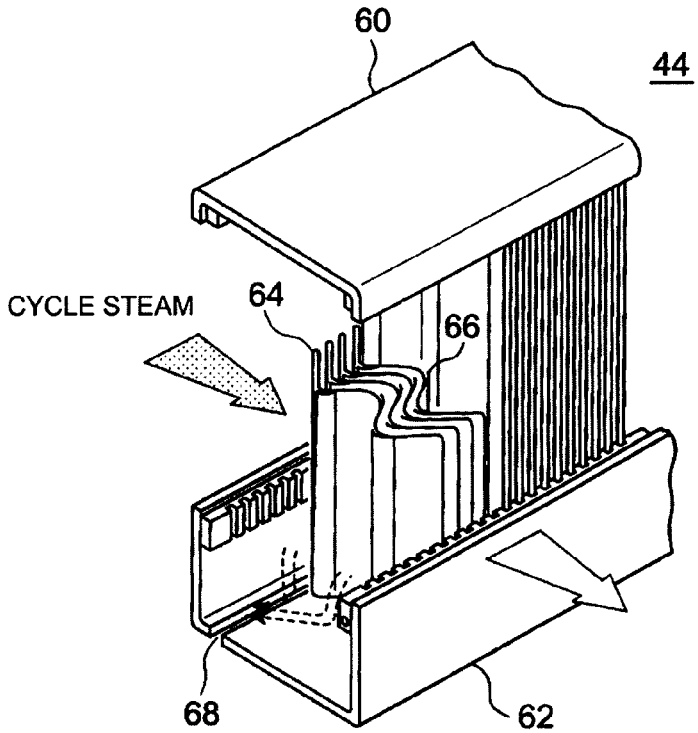

As the demister 44, a chevron type demister can be used. FIG. 5 shows a bird view of an exemplary configuration regarding the demister of a chevron type. In the demister 44 in FIG. 5, a number of corrugated panels 64 are fitted to a frame 60 on the upper side of the demister 44 as well as the lower side of the demister 44. A moisture (mist) catching plate 66 is fitted to each corrugated panel 64 so as to be arranged in the neighborhood of the corrugation ridge along the corrugation ridge line. The moisture of the cycle steam streaming between a corrugated panel 64 and the adjacent corrugated panel 64 comes into collision with the moisture catching plate 66; then, the moisture (mist), namely, the droplet of water coming into collision with the moisture catching plate 66 streams downward along the plate 66. And, the water runs down into a drain groove 68. In this way, the moisture in the cycle steam is separated.

Further, instead of the chevron type demister, the demister 44 may be of a wire mesh type. In a demister 44 of the wire mesh type, when the cycle steam comes into collision with the wire mesh of the demister, the moisture as droplets of water adheres to the surfaces of the wire mesh; and the water drops down with gravity so that the moisture of the cycle steam is separated from the steam.

As explained thus far, according to this second mode, the steam turbine 20 is provided with the moisture separation heater 22 on a part way of the steam passage 6; thus, in addition to the effects obtained by applying the steam turbine 1, the steam turbine 20 provide the advantageous effects that the erosion regarding the intermediate-pressure turbine 4 can be prevented, the erosion being attributable to the water droplet included in the steam flow streaming through the intermediate-pressure turbine 4. Further, the turbine performance deterioration can be also prevented; and, the heat cycle efficiency of the steam turbine 20 can be enhanced. Moreover, a moisture separation heater 34 is provided on a part way of a steam passage line that connects the steam inlet of the low-pressure turbine 32, to the confluence point of the steam discharge line from the high-and-intermediate pressure turbine 2 and the steam discharge line from the intermediate pressure turbine 4; thus, re-heating over two stages is performed in the whole steam cycle by use of the moisture separation heaters 22 and 34. Accordingly, the heat cycle efficiency can be remarkably enhanced.

It is hereby noted that, although each of the moisture separation heaters 22 and 34 depicted in FIG. 2 or 3 uses a moisture separator that removes the moisture of the steam as well as a heater that heats up the steam, each of the moisture separation heaters 22 or 34 may be only a moisture separator.

Regarding the case as described above, for instance, in a case where the steam passage 6 is formed only inside of the high-and-intermediate pressure casing, a moisture separation mechanism of the chevron type or of the wire mesh type can be installed in the stream passage 6; on the other hand, in a case where a part of the steam passage 6 is formed outside of the high-and-intermediate pressure casing, a moisture separator of the chevron type or of the wire mesh type can be arranged in the neighborhood of the steam turbine.

As described above, the modes according to the present invention are explained in detail. It goes without saying that these modes may be modified or improved in various ways, unless the improvement or the modification of these modes deviates from the points of the present invention.

In the examples according to the above-described modes, it is explained, for instance, that the rotor for the high-and-intermediate pressure turbine 2 and the rotor for the intermediate-pressure turbine 4 are housed in a common casing. However, it goes without saying that the casing of the rotor for the high-and-intermediate pressure turbine 2 may be independent of the casing of the rotor for the intermediate-pressure turbine 4.

The invention claimed is:

1. A method for operating a steam turbine, the steam turbine comprising a single flow high-and-intermediate pressure turbine, the high-and-intermediate pressure turbine having a high-pressure part and an intermediate-pressure part on a downstream side of the high-pressure part;

a single flow intermediate-pressure turbine; and a low-pressure turbine, the high-and-intermediate pressure turbine, the intermediate-pressure turbine, and the low-pressure turbine being disposed between a steam inlet and a steam outlet, the method comprising:

expanding a steam supplied through the steam inlet of the high-and-intermediate pressure turbine in the high-pressure part;

branching a flow of the steam having passed through the high-pressure part into a flow of a first steam and a flow of a second steam;

expanding the first steam in the intermediate-pressure part of the high-and-intermediate pressure turbine;

leading the second steam into the intermediate-pressure turbine so as to expand the second steam in the intermediate-pressure turbine; and leading the first steam having passed through the intermediate-pressure part and the second steam having passed through the intermediate-pressure turbine into the low-pressure turbine.

2. A steam turbine comprising:

a single flow high-and-intermediate pressure turbine configured to have a steam stream fed through a steam inlet to a steam outlet via a high-pressure part and a downstream intermediate-pressure part within the high-and-intermediate pressure turbine;

a single flow intermediate-pressure turbine;

a steam passage configured to communicate a location between the high-pressure part and the intermediate-pressure part of the high-and-intermediate pressure turbine to an inlet of the intermediate-pressure turbine;

a low-pressure turbine; and a steam line configured to communicate a steam inlet of the low-pressure turbine to the steam outlet of the high-and-intermediate pressure turbine and a steam outlet of the intermediate pressure turbine, wherein the steam passage is configured to feed a part of the steam having passed through the high-pressure part of the high-and-intermediate pressure turbine to the intermediate-pressure turbine, and wherein the steam line is configured to feed the steam having passed through the intermediate-pressure part of the high-and-intermediate pressure turbine and the steam having passed through the intermediate pressure turbine to the low-pressure turbine.

3. The steam turbine according to claim 2, wherein the high-and-intermediate pressure turbine and the intermediate-pressure turbine are housed in a common casing.

4. The steam turbine according to claim 3, wherein the steam passage is disposed inside the common casing.

5. The steam turbine according to claim 3, wherein the steam passage is disposed at least partially outside the common casing.

6. The steam turbine according to claim 5, further comprising a moisture separation device disposed in the steam passage outside the common casing and being configured to separate moisture of the steam streaming through the steam passage.

7. The steam turbine according to claim 6, further comprising:

a heating device disposed in the steam passage outside the common casing and being configured to heat up the steam streaming through the steam passage.

8. The steam turbine according to claim 2, wherein the steam turbine further comprises a moisture separation device disposed in the steam passage, and being configured to separate moisture of the steam streaming through the steam passage.

9. The steam turbine according to claim 8, wherein the steam turbine further comprises a heating device disposed in the steam passage, and being configured to heat-up the steam streaming through the steam passage.

10. The steam turbine according to claim 2, wherein the steam turbine is configured to enable a flow rate of the steam streaming through the intermediate-pressure part in the high-and-intermediate pressure turbine to be approximately equal to a flow rate of the steam streaming through the intermediate-pressure turbine.

11. The steam turbine according to claim 2, wherein the high-and-intermediate pressure turbine and the intermediate-pressure turbine are arranged to be on a same axis; and the high-and-intermediate pressure turbine is configured so as to enable a direction of a steam flow to be opposite to a direction of a steam flow in the intermediate-pressure turbine.

12. The steam turbine according to claim 2, wherein the high-and-intermediate pressure turbine and the intermediate turbine are disposed on a same axis such that a direction of a steam flow in the high-and-intermediate pressure turbine is opposite to a direction of a steam flow in the intermediate-pressure turbine, and wherein the steam turbine further comprises a dummy disposed on the same axis between the high-and-intermediate pressure turbine and the intermediate turbine and being configured to reduce total thrust force acting on the high-and-intermediate pressure turbine and the intermediate turbine.

13. A power plant comprising:

a steam turbine; and a generator configured to be driven by the steam turbine to produce power, wherein the steam turbine comprises:

a high-and-intermediate pressure turbine of a single flow type in which a steam stream fed through a steam inlet to a steam outlet via a high-pressure part and a downstream intermediate-pressure part within the high-and-intermediate pressure turbine;

an intermediate-pressure turbine of a single flow type;

a low-pressure turbine; and a steam line configured to communicate a steam inlet of the low-pressure turbine to the steam outlet of the high-and-intermediate pressure turbine and a steam outlet of the intermediate pressure turbine, a steam passage that communicates a location between the high-pressure part and the intermediate-pressure part of the high-and-intermediate pressure turbine to an inlet of the intermediate-pressure turbine, wherein a part of the steam having passed through the high-pressure part of the high-and-intermediate pressure turbine is fed to the intermediate-pressure turbine via the steam passage, and wherein the steam line is configured to feed the steam having passed through the intermediate-pressure part of the high-and-intermediate pressure turbine and the steam having passed through the intermediate pressure turbine to the low-pressure turbine.

14. The power plant according to claim 13, further comprising a nuclear reactor configured to generate the steam to be fed to the high-and-intermediate pressure turbine, wherein the steam turbine further comprises a low-pressure turbine configured to be supplied with the steam having passed through the intermediate-pressure part of the high-and-intermediate pressure turbine, and the steam having passed through the intermediate-pressure turbine.

* * * * *